US007082994B2

(12) United States Patent
Frost, Jr. et al.

(10) Patent No.: US 7,082,994 B2
(45) Date of Patent: Aug. 1, 2006

(54) RADIALLY ADJUSTABLE DOWNHOLE DEVICES AND METHODS FOR SAME

(75) Inventors: Elton Frost, Jr., Houston, TX (US); Ole G. Engels, Houston, TX (US); Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 144 days.

(21) Appl. No.: 10/780,167

(22) Filed: Feb. 17, 2004

(65) Prior Publication Data

US 2004/0216873 A1 Nov. 4, 2004

Related U.S. Application Data

(60) Provisional application No. 60/448,388, filed on Feb. 18, 2003.

(51) Int. Cl.
*E21B 47/12* (2006.01)

(52) U.S. Cl. ..... 166/254.2; 166/255.1; 166/264; 166/381

(58) Field of Classification Search ..... None
See application file for complete search history.

(56) References Cited

U.S. PATENT DOCUMENTS 3,865,188 A * 2/1975 Doggett et al. ..... 166/285
3,990,304 A 11/1976 Roesner ..... 73/151
4,688,640 A 8/1987 Pritchard, Jr. ..... 166/365
5,893,413 A 4/1999 Lembcke et al. ..... 166/66.6
6,041,860 A 3/2000 Nazzal et al. ..... 166/250.01
6,179,066 B1 1/2001 Nasr et al. ..... 175/45
6,604,582 B1 * 8/2003 Flowers et al. ..... 166/332.1
6,651,747 B1 11/2003 Chen et al. ..... 166/382

FOREIGN PATENT DOCUMENTS

EP 0313374 4/1989

* cited by examiner

*Primary Examiner*—Zakiya W. Bates
(74) *Attorney, Agent, or Firm*—Madan, Mossman & Sriram, P.C.

(57) ABSTRACT

A method for logging a wellbore includes actuating a positioning device to adjust the position of a module relative to a reference point or object such as a wellbore axis or proximally positioned downhole device. With respect to a wellbore, an exemplary positioning device can set the measurement tool such as an acoustic device to successive radial positions (e.g., substantial concentricity or substantial eccentricity relative to an axis of the wellbore). In one embodiment, the module includes a measurement tool to measure different parameters of interest (e.g., acoustic logging data, check-shot data measurement, bonding of cement to casing). With respect to an adjacent downhole device, the positioning device can provide a selected relative orientation (e.g., azimuth, inclination, radial displacement) between the module and the adjacent downhole device. The positioning device can also be adapted to apply a jarring force to a wall of the wellbore to free a downhole device.

24 Claims, 6 Drawing Sheets

RADIALLY ADJUSTABLE DOWNHOLE DEVICES AND METHODS FOR SAME

CROSS-REFERENCE TO RELATED APPLICATIONS

This application Claims the benefit of earlier filed provisional U.S. patent application Ser. No. 60/448,388, filed on Feb. 18, 2003.

FIELD OF THE INVENTION

This invention relates generally to oilfield wellbore tools and more particularly to well logging devices that have radially adjustable modules.

BACKGROUND OF THE ART

Oil or gas wells are often surveyed to determine one or more geological, petrophysical, geophysical, and well production properties ("parameters of interest") using electronic measuring instruments conveyed into the wellbore by an umbilical such as a cable, a wireline, slickline, drill pipe or coiled tubing. Tools adapted to perform such surveys are commonly referred to as formation evaluation tools. These tools use electrical, acoustical, nuclear and/or magnetic energy to stimulate the formations and fluids within the wellbore and measure the response of the formations and fluids. The measurements made by downhole instruments are transmitted back to the surface. In many instances, multiple trips or logging runs are needed to collect the necessary data.

As is known to those versed in the art, certain tools collect a first set of data while in a substantially concentric position relative to the wellbore and collect a second set of data while in a substantial eccentric position relative to the wellbore. Conventionally, the position of tools on an umbilical are static or fixed. Thus, two or more logging runs may be required to collect the two types of data, even though one tool can collect both types of data. As is also known in the art, certain logging runs can utilize a dozen or more different measurement tools in a single package. Each of these tools may require a different position relative to the wellbore (e.g., radial position relative to the wellbore axis) and/or different physical orientation relative to one another.

Merely by way of illustration and not to limit the scope and application of the present invention, reference is made to a nuclear magnetic resonance ("NMR") tool such as that described in U.S. patent application Ser. No. 09/997,451 ("'451 Application") having the same assignee as the present application and the contents of which are fully incorporated herein by reference. The '451 Application describes an NMR tool that may be operated in a centralized position in a small diameter borehole and in a decentralized position in a large diameter borehole. The NMR tool is merely representative of a number multi-purpose tools that, conventionally, are re-set in different radial positions (e.g., alignment, orientation, etc.) at the surface in order to perform different tasks downhole (e.g., collect different types of data).

The present invention addresses these and other drawbacks of conventional well tools.

SUMMARY OF THE INVENTION

The present invention provides a tool system having at least one module that can be placed in a selected position relative to a reference object. The selected position can be a radial position relative to a wellbore axis or a selected orientation (e.g., azimuth, inclination) relative to an adjacent module. The tool system is adapted to be deployed at a rig that is positioned over a subterranean formation of interest. In one embodiment, the tool system is conveyed downhole via a wireline into a wellbore and includes one or more modules housing a measurement device adapted to measure a parameter of interest. In one embodiment, the module carrying the measurement device is provided with a positioning device. The positioning device is configured to adjust and/or maintain an associated module at a selected radial position relative to a reference point or object (e.g., wellbore axis or proximally positioned downhole device). The positioning device adjusts in situ the radial position of module upon receiving a command signal and/or automatically in a closed-loop type manner. This selected radial position is maintained or adjusted independently of the radial position(s) of an adjacent module or modules. An exemplary positioning device includes a plurality of independently adjustable positioning members and associated drive assemblies. The drive assemblies and the positioning members are configured to provide fixed or adjustable radial displacement and/or fixed or adjustable amount of force against the wellbore wall. The tool system communicates with surface equipment (e.g., a controller) via telemetry equipment that provides two-way exchanging data/command signals.

In another embodiment of the present invention, the positioning device is adapted to provide a selected orientation for a module relative to an adjacent module. For instance, the positioning device can include a swivel driven by a suitable mechanism that orients a first module at a selected inclination relative to a second module. The swivel can also be configured to set the first module at a selected azimuth relative to a second module or set both a relative azimuth and inclination. In still another embodiment of the present invention, the positioning device is adapted to provide a jarring force. For instance, the positioning members of the positioning device are adapted to jar a device such as a formation-sampling tool free by inducing a steady or pulsed radial force against the wellbore wall.

In one manner of operation involving an acoustic tool, the acoustic tool is conveyed into the wellbore by a tool module until the acoustic tool is positioned adjacent an open hole section. If needed, the acoustic tool is set in a centralized position relative to the wellbore axis for acoustic logging. After acoustic logging is complete, actuation of one or more positioning devices places the acoustic tool in a substantially eccentric or decentralized radial position relative to the wellbore. This decentralized position can, for instance, acoustically couple the acoustic tool to the wellbore wall and enable check-shot measurements. During the data collection, the controllers can be configured to analyze the measurement by, for example, comparing the data to a predetermined model. After completion of acoustic logging and taking of check-shot data measurements (on the same logging run), the tool can be positioned in the cased region of the wellbore. In this position, the positioning devices set the acoustic tool in a substantially concentric position for to collected different data, e.g., data relating to the bonding of the cement to the casing.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF THE PREFERRED EMBODIMENT

Figure 1:
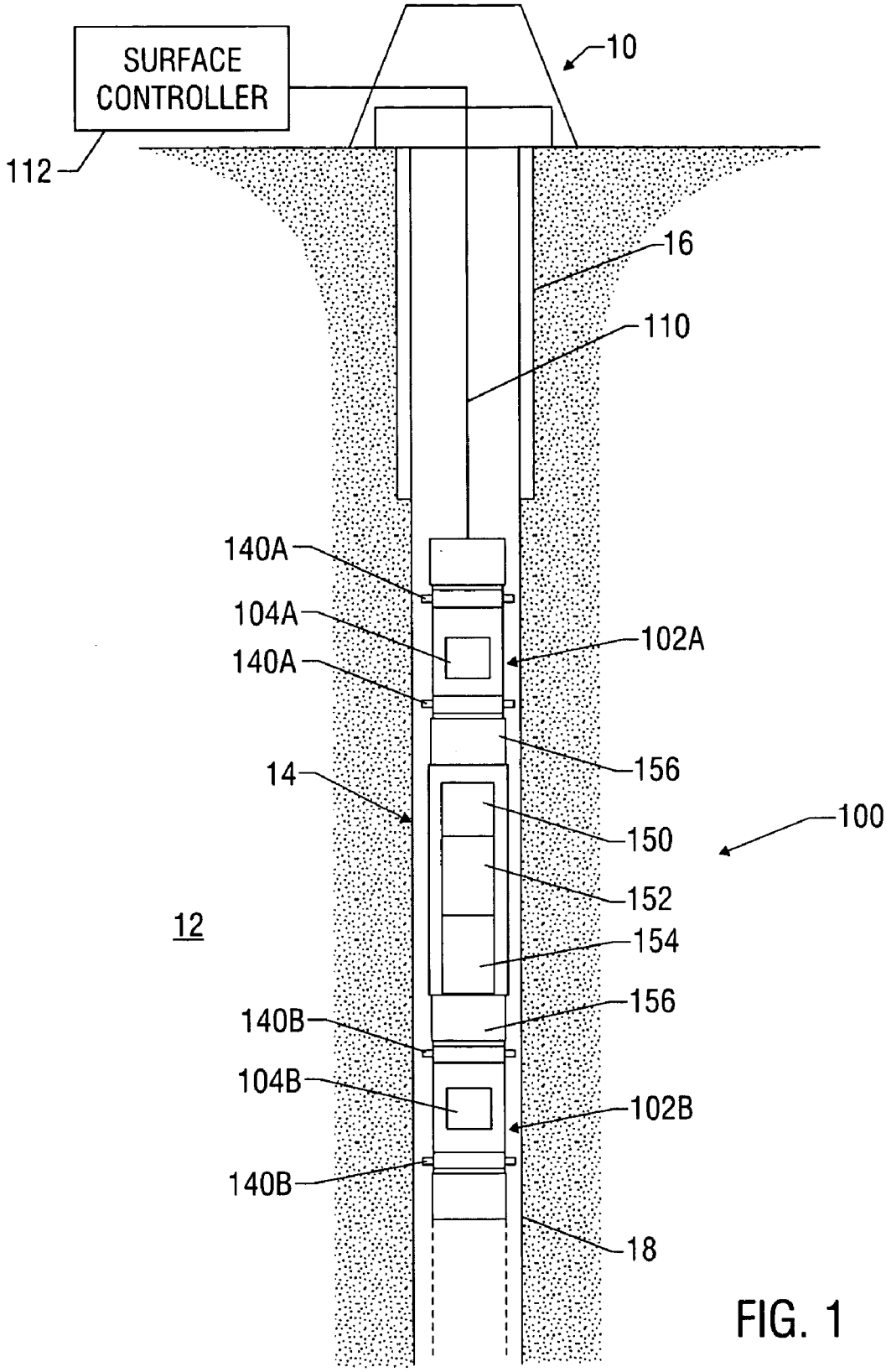
FIG. 1 is a schematic illustration of one embodiment of a system using a radially adjustable module adapted for use in logging operations.
Figure 2:
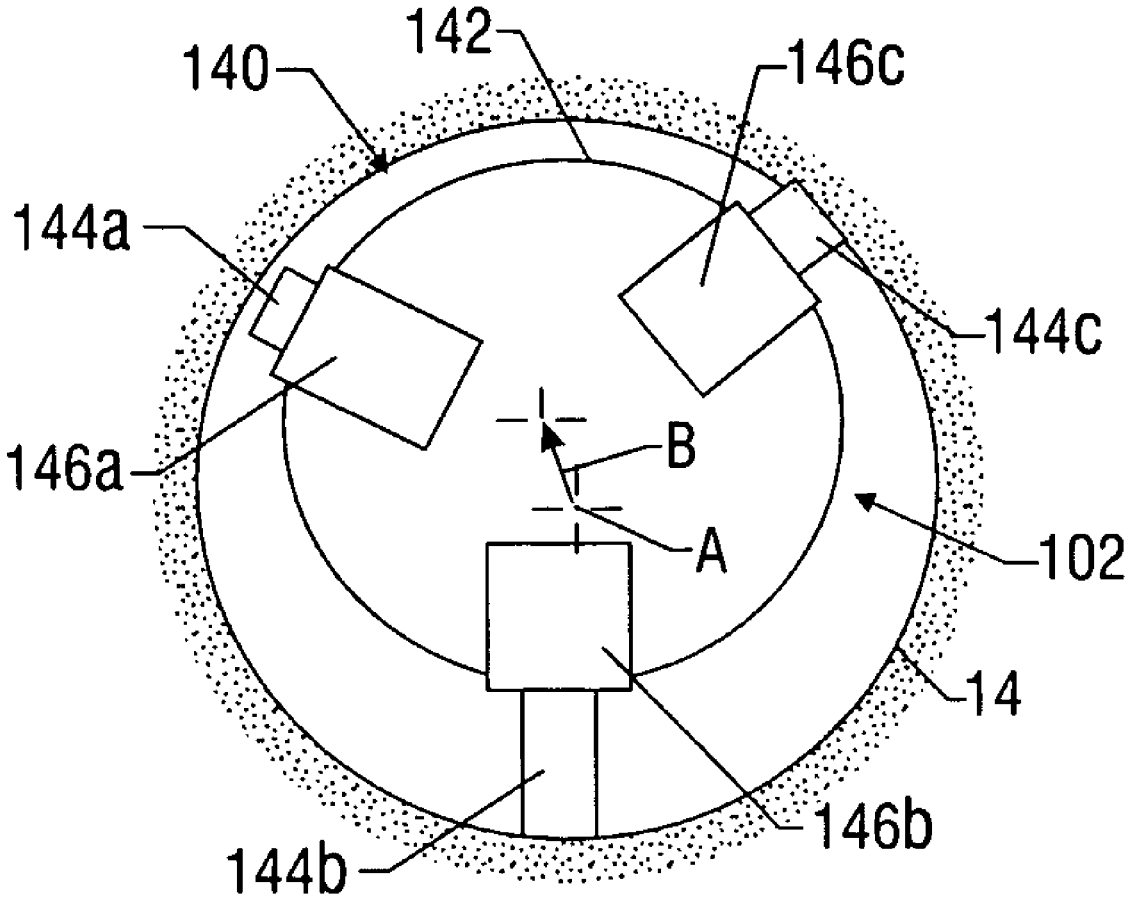
FIG. 2 illustrates a sectional view of one embodiment of a positioning device made in accordance with the present invention.

Referring initially to FIG. 1, there is shown a rig 10 on the surface that is positioned over a subterranean formation of interest 12. The rig 10 can be a part of a land or offshore a well production/construction facility. A wellbore 14 formed below the rig 10 includes a cased portion 16 and an open hole portion 18. In certain instances (e.g., during drilling, completion, work-over, etc.), a logging operation is conducted to collect information relating to the formation 12 and the wellbore 14. Typically, a tool system 100 is conveyed downhole via an umbilical 110 to measure one or more parameters of interest relating to the wellbore 14 and/or the formation 12. The term "umbilical" as used hereinafter includes a cable, a wireline, slickline, drill pipe, coiled tubing and other devices suitable for conveying a tool into a wellbore. The tool system 100 can include one or more modules 102*a,b*, each of which has a tool or a plurality of tools 104*a,b*, adapted to perform one or more downhole tasks. The term "module" should be understood to be a device such as a sonde or sub that is suited to enclose, house, or otherwise support a device that is to be deployed into a wellbore. While two proximally positioned modules 102*a,b* and two associated tools 104*a,b*, are shown, it should be understood that a greater or fewer number may be used.

In one embodiment, the tool 104*a* is formation evaluation tool adapted to measure one or more parameters of interest relating to the formation or wellbore. It should be understood that the term formation evaluation tool encompasses measurement devices, sensors, and other like devices that, actively or passively, collect data about the various characteristics of the formation, directional sensors for providing information about the tool orientation and direction of movement, formation testing sensors for providing information about the characteristics of the reservoir fluid and for evaluating the reservoir conditions. The formation evaluation sensors may include resistivity sensors for determining the formation resistivity, dielectric constant and the presence or absence of hydrocarbons, acoustic sensors for determining the acoustic porosity of the formation and the bed boundary in formation, nuclear sensors for determining the formation density, nuclear porosity and certain rock characteristics, nuclear magnetic resonance sensors for determining the porosity and other petrophysical characteristics of the formation. The direction and position sensors preferably include a combination of one or more accelerometers and one or more gyroscopes or magnetometers. The accelerometers preferably provide measurements along three axes. The formation testing sensors collect formation fluid samples and determine the properties of the formation fluid, which include physical properties and chemical properties. Pressure measurements of the formation provide information about the reservoir characteristics.

In certain embodiments, the tool system 100 can include telemetry equipment 150, a local or downhole controller 152 and a downhole power supply 154. The telemetry equipment 150 provides two-way communication for exchanging data signals between a surface controller 112 and the tool system 100 as well as for transmitting control signals from the surface processor 112 to the tool system 100.

In an exemplary arrangement, and not by way of limitation, a first module 102*a* includes a tool 104*a* configured to measure a first parameter of interest and a second module 102*b* includes a tool 104*b* that is configured to measure a second parameter of interest that is either the same as or different from the first parameter of interest. In order to execute their assigned tasks, tools 104*a* and 104*b* may need to be in different positions. The positions can be with reference to an object such as a wellbore, wellbore wall, and/or other proximally positioned tooling. Also, the term "position" is meant to encompass a radial position, inclination, and azimuthal orientation. Merely for convenience, the longitudinal axis of the wellbore ("wellbore axis") will be used as a reference axis to describe the relative radial positioning of the tools 104*a,b*. Other objects or points can also be used as a reference frame against which movement or position can be described. Moreover, in certain instances, the tasks of the tools 104*a,b* can change during a wellbore-related operation. Generally speaking, tool 104*a* can be adapted to execute a selected task based on one or more selected factors. These factors can include, but not limited to, depth, time, changes in formation characteristics, and the changes in tasks of other tools.

In accordance with one embodiment of the present invention, modules 102*a* and 102*b* are each provided with positioning devices 140*a*, 140*b*, respectively. The positioning device 140 is configured to maintain a module 102 at a selected radial position relative to a reference position (e.g., wellbore axis). The position device 140 also adjusts the radial position of module 102 upon receiving a surface command signal and/or automatically in a closed-loop type manner. This selected radial position is maintained or adjusted independently of the radial position(s) of an adjacent downhole device (e.g., measurement tools, sonde, module, sub, or other like equipment). An articulated member, such a flexible joint 156 which couples the module 102 to the tool system 100 provides a degree of bending or pivoting to accommodate the radial positioning differences between adjacent modules and/or other equipment (for example a processor sonde or other equipment). In other embodiments, one or more of the positioning devices has fixed positioning members.

According to one embodiment, the positioning device 140 includes a body 142 having a plurality of positioning members 144(*a,b,c*) circumferentially disposed in a space-apart relation around the body 142. The members 144(*a,b,c*) are adapted to independently move between an extended position and a retracted position. The extended position can be either a fixed distance or an adjustable distance. Suitable positioning members 144(*a,b,c*) include ribs, pads, pistons, cams, inflatable bladders or other devices adapted to engage a surface such as a wellbore wall or casing interior. In certain embodiments, the positioning members 144(*a,b,c*) can be configured to temporarily lock or anchor the tool in a fixed position relative to the wellbore and/or allow the tool to move along the wellbore.

Drive assemblies 146(*a,b,c*) are used to move the members 144(*a,b,c*). Exemplary embodiments of drive assemblies 146(*a,b,c*) include an electro-mechanical system (e.g., an electric motor coupled to a mechanical linkage), a hydraulically-driven system (e.g., a piston-cylinder arrangement fed with pressurized fluid), or other suitable system for moving the members 144(*a,b,c*) between the extended and retracted positions. The drive assemblies 146(*a,b,c*) and the members 144(*a,b,c*) can be configured to provide a fixed or adjustable amount of force against the wellbore wall. For instance, in a positioning mode, actuation of the drive assemblies 146(*a,b,c*) can position the tool in a selected radial alignment or position. The force applied to the wellbore wall, however, is not so great as to prevent the tool from being moved along the wellbore. In a locking mode, actuation of the drive assembly 146(*a,b,c*) can produce a sufficiently high frictional force between the members 144(*a,b,c*) and the wellbore wall as to prevent substantial relative movement. In certain embodiments, a biasing member (not shown) can be used to maintain the positioning members 144(*a,b,c*) in a pre-determined reference position. In one exemplary configuration, the biasing member (not shown) maintains the positioning member 144(*a,b,c*) in the extended position, which would provide centralized positioning for the module. In this configuration, energizing the drive assembly overcomes the biasing force of the biasing member and moves one or more of the positioning members into a specified radial position, which would provide decentralized positioning for the module. In another exemplary configuration, the biasing member can maintain the positioning members in a retracted state within the housing of the positioning device. It will be seen that such an arrangement will reduce the cross sectional profile of the module and, for example, lower the risk that the module gets stuck in a restriction in the wellbore.

The positioning device 140 and drive assembly 146(*a,b,c*) can be energized by a downhole power supply (e.g., a battery or closed-loop hydraulic fluid supply) or a surface power source that transmits an energy stream (e.g., electricity or pressurized fluid) via a suitable conduit, such as the umbilical 120. Further, while one drive assembly (e.g., drive assembly 146*a*) is shown paired with one positioning member 144 (e.g., position member 144*a*), other embodiments can use one drive assembly to move two or more positioning members.

Figure 3A:
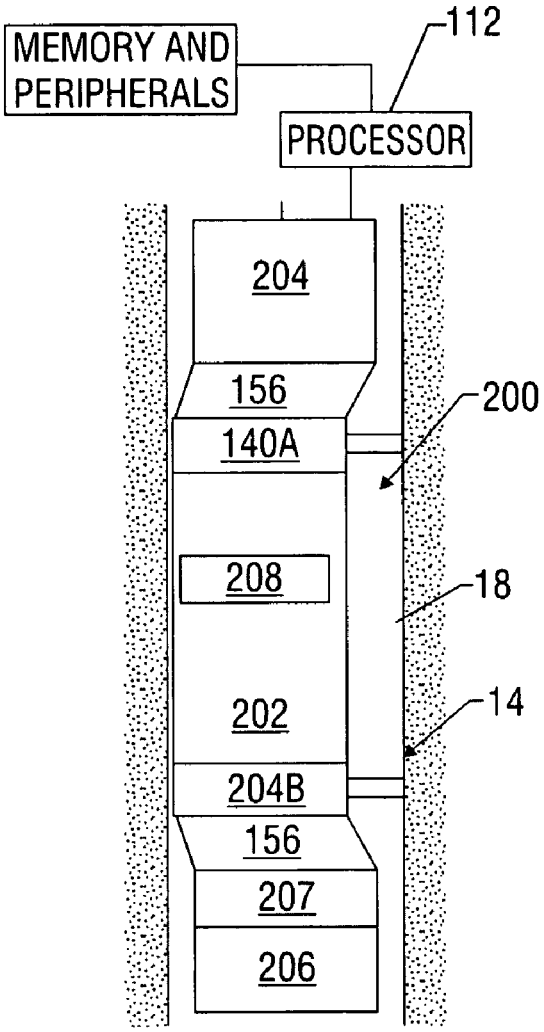
FIG. 3A is a schematic elevation view of radially adjustable module positioned in an open hole portion of a wellbore.
Figure 3B:
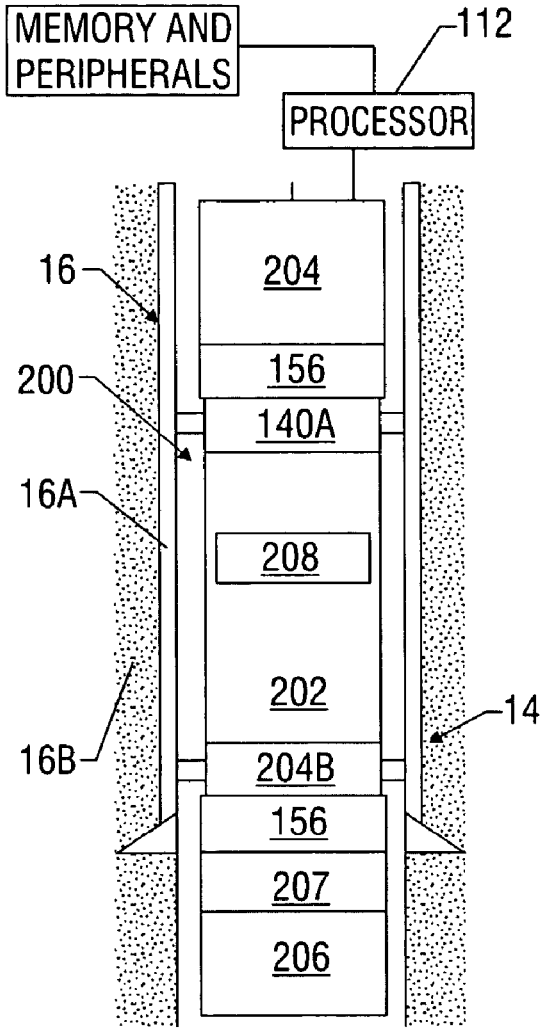
FIG. 3B is a schematic elevation view of radially adjustable module positioned in a cased portion of a wellbore.

Referring now to FIGS. 3A and 3B there is shown an exemplary formation evaluation tool system 200 disposed in an open hole section 18 and cased section 16 of a well, respectively. The tool system 200 includes a plurality of modules or subs for measuring parameters of interest. An exemplary module 202 is shown coupled to an upper tool section 204 and a lower tool section 206 by a flexible member 156. In one exemplary embodiment, the module 202 supports an acoustic tool 208. When in the open hole 18, the acoustic tool 208 may be set in a decentralized position (i.e., radially eccentric position) by actuating the positioning members 140*a* and 140*b*. This decentralized or radially offset position is substantially independent of the radial positions of the downhole device (e.g., measurement devices and sensors) along or in the upper/lower tool string section 204 and 206. That is, the upper or tool string section 204 and 206 can have formation evaluation sensors and measurement devices that are in a radial position that is different from that of the module 202. In this decentralized or radially offset position, the acoustic tool can be used to gather data such as checkshot data. In certain instances, it may be advantageous to move the module 202 in a planetary fashion along the wellbore wall. It should be appreciated that such motion can be accomplished by sequentially varying the distance of extension/retraction of the positioning members.

In FIG. 3B, the acoustic tool 202 is shown in the cased section 16 of the wellbore 14. In this cased section 16, the positioning members 140*a,b* are energized to bring the acoustic tool 208 into a centralized position or concentric position relative to the wellbore 14. In this position or alignment, the acoustic tool can be configured to measure or evaluate the bond between the casing 16A and the cement 16B. This re-alignment of the positioning members 140*a,b* can be initiated by either a locally generated command signal or a surface transmitted command signal.

Figure 3C:
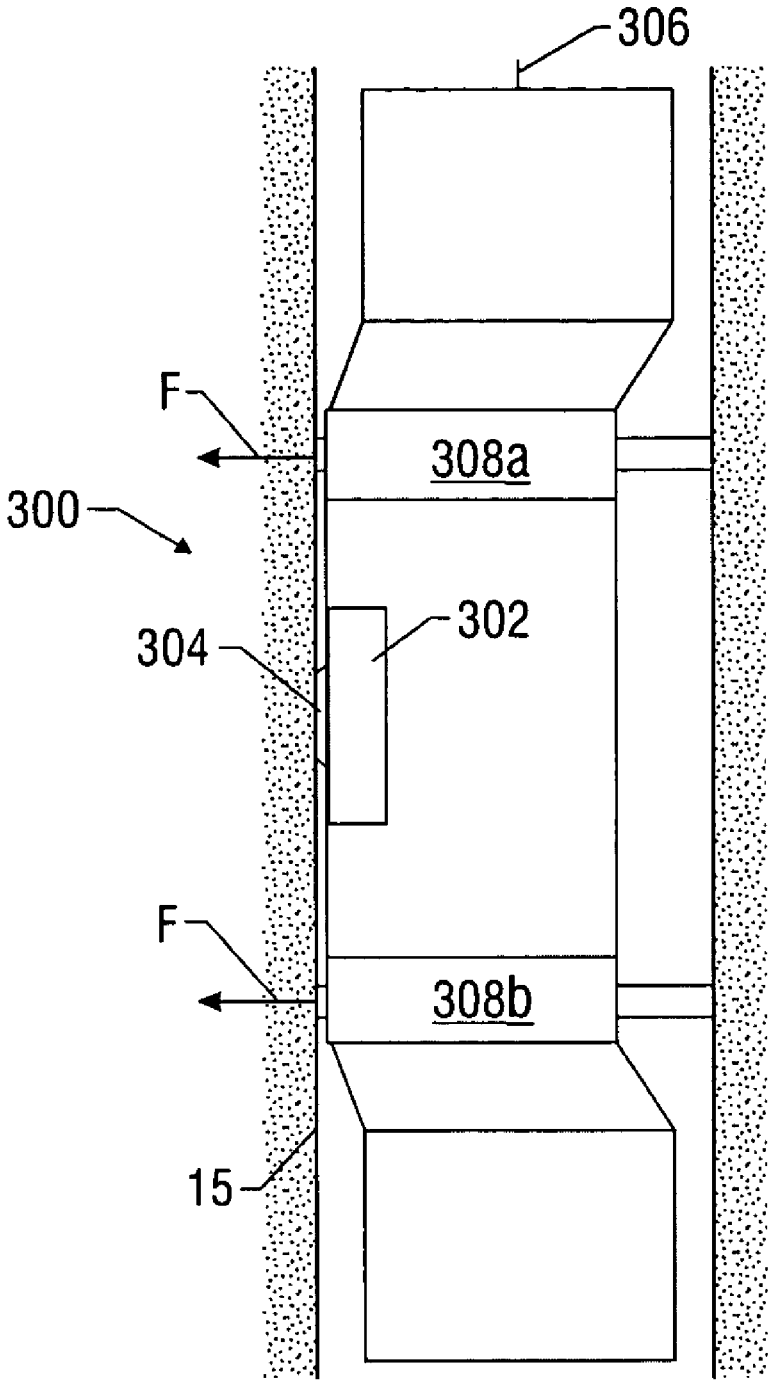
FIG. 3C is a schematic elevation view of a module provided with an embodiment of a jarring device made in accordance with the present invention.

Referring now to FIG. 3C, in another embodiment of the present invention, the tool 300 can include a fluid sampling tool 302 for collecting and testing formation fluids. Conventionally, such tools include a sampling tube 304 that engages the wellbore wall 15 and, by inducing a vacuum or negative pressure, draws wellbore fluids into sampling chambers (not shown). In certain situations, after the sampling is complete, a residual vacuum pressure remaining in the tube 304 prevents the tool 302 from dislodging from the wellbore wall 15. Conventionally, efforts to free the tool 300 involve changing the tension force applied to the umbilical 306 on which the tool 300 is suspended. In accordance with one embodiment of the present invention, the tool includes the positioning members 308*a,b* that, when energized, jars the formation-sampling tool free by inducing a steady or pulsed radial force F against the wellbore wall 15.

Figure 3D:
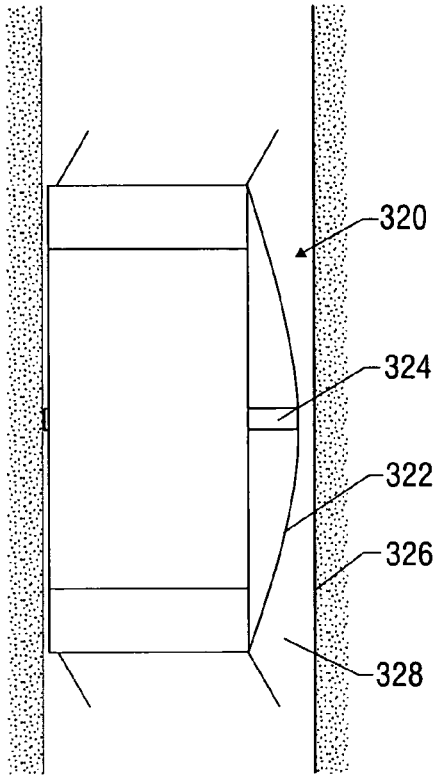
FIG. 3D is a schematic elevation view of an alternate embodiment of a positioning member.
Figure 3E:
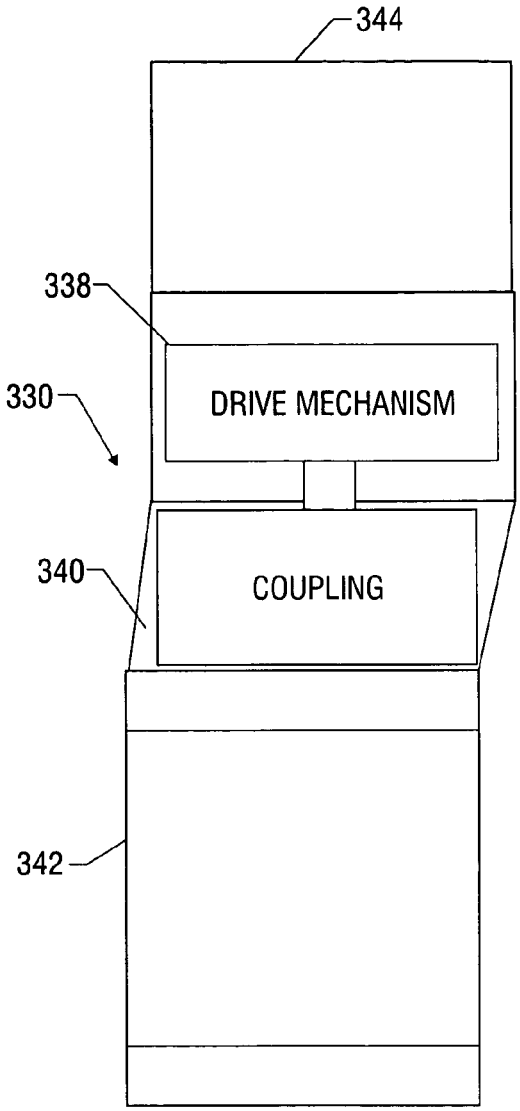
FIG. 3E is a schematic elevation view of yet an alternate embodiment of a positioning member.

Referring now to FIG. 3D, there is shown an alternate embodiment of a positioning device 320 that uses an extending member 322 to selectively flex a flexible member 324 such as a bow spring. The flexible member 324 provides an arcuate surface that can be dragged along a wellbore wall 326 with reduced risk of damage and/or getting stuck in the wellbore 328. Referring now to FIG. 3E, there is shown a positioning device 330 that provides a module 332 with an orientation relative to another module such as adjacent module 334. In the FIG. 3E embodiment, the position of the module 332 is adjusted without engaging a wellbore wall (not shown). Rather, in one embodiment, a drive mechanism 338 actuates a coupling joint 340. The coupling joint 340 is adapted to provide one or more degrees of articulation between a first module 332 and a second module 334. Exemplary relative motion includes relative translational motion, relative rotational motion, and azimuthal rotation between the first and second modules 332, 334. Thus, the coupling joint 340 allows the first and second modules 332, 334 to have different radial locations (e.g., non-concentric tool or longitudinal center lines), different inclinations, and point in different azimuthal directions. Suitable drive mechanisms include, but not limited to, electric and hydraulic motors and hydraulic pistons energized by a pressurized fluid (e.g., gas or oil). The coupling joint 340 can include a swivel arrangement and other suitable articulated members.

Figure 4:
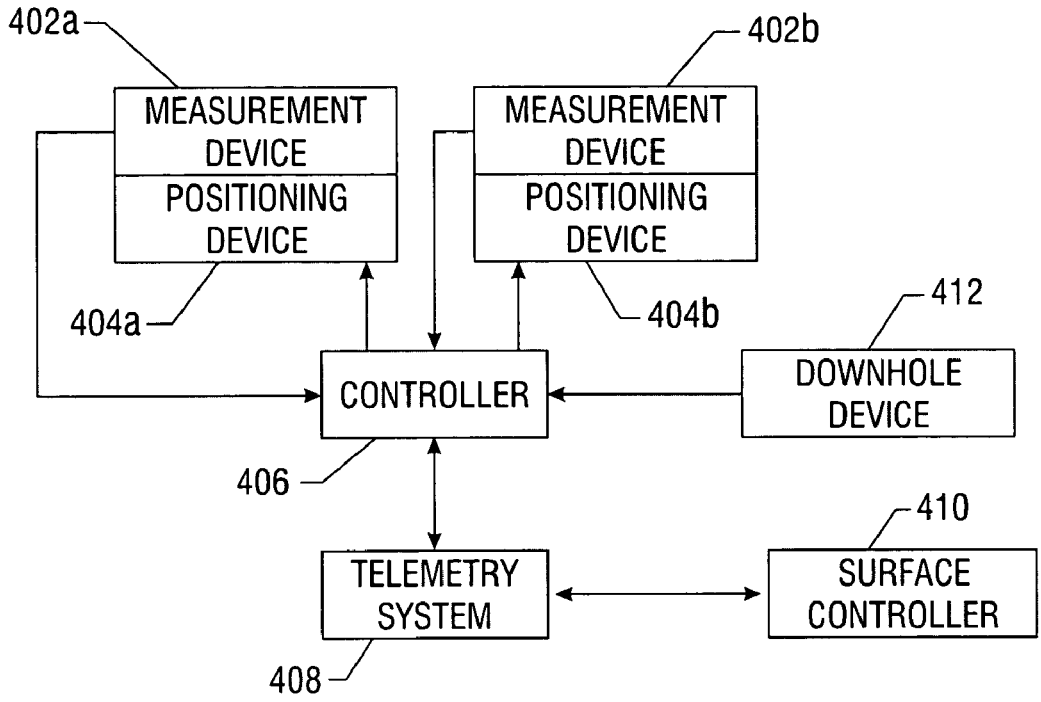
FIG. 4 schematically illustrates one embodiment of an arrangement according to the present invention wherein a positioning tool is configured to adjust the radial position of a measurement device.

Referring now to FIG. 4 there is a schematically illustrated an embodiment of the present invention configured to measure formation data during a logging operation. A tool system 400 conveyed via a wireline (not shown) includes one or more formation evaluation tools 402*a*, 402*b*, etc. Each tool 402*a*, 402*b* includes an associated positioning device 404*a*, 404*b*. In one embodiment, a controller 406 is configured to operate the positioning devices 404*a,b* to thereby control the radial positioning of the tools 402*a*, 402*b*. The controller 406 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the tool system 400 and the surface controller 410 via two-way telemetry system 408.

For convenience, a single controller 406 is shown. It should be understood, however, that a plurality of controllers can also be used. For example, a downhole controller can be used to collect, process and transmit data to a surface controller, which further processes the data and transmits appropriate control signals downhole. Other variations for dividing data processing tasks and generating control signals can also be used. The controller can, thus, operate autonomously (e.g., semi-closed loop or closed-loop operation) or interactively. In certain embodiments, the controller can re-align the positioning members upon receiving surface instructions and/or re-align the positioning members using pre-programmed data (e.g., well profile data such as depth). Dynamic radial position can also, in certain instances, be used to optimize the collection of data by, for example, adjusting the position of the measurement devices 402*a,b* to correct for factors that influence the data measurements. Further, the controller 406 can utilize a static or dynamically-updated model to evaluate the quality of data collected by the measurement devices 402*a,b* and issue command signals that re-align the positioning members to correct or optimize the data measurements. The controller 406 can also be configured to collect data from other downhole devices (e.g., sensors and measurement devices). The data from these other evaluation tools 412 (e.g., azimuth, tool face orientation, inclination) can also be to correct and/or optimize the data measurement process.

Referring now to FIGS. 3A,B, in one manner of operation, the tool package 100 is conveyed into the wellbore 14, until the tool package is positioned adjacent an open hole section 18. The wellbore 12 can include vertical sections, inclined sections or deviated sections and any horizontal portions. In one embodiment, the measurement device 208 is configured as an acoustic tool. For acoustic logging, the measurement device 208 is set in a centralized position relative to the wellbore axis. After acoustic logging is complete, the surface controller 112 and/or the downhole controller 207 actuate one or more positioning devices 204*a,b* to place the tool 208 in a substantially eccentric or decentralized radial position relative to the wellbore 14. This decentralized position can place the acoustic tool in physical contact with the wall of the wellbore 14. This physical contact provides acoustical coupling that enables the collection of check-shot measurements. During the data collection, the controllers 112,207 can be configured to analyze the measurement by, for example, comparing the data to a pre-determined model. Based on this comparison, the controllers 112,207 can issue command signals as needed to adjust the radial position of the tool 208 to improve the quality of the measured data. Thus, for example, the controller can compensate for tool orientation in deviated portions of the wellbore by adjusting the positioning tool to maintain the tool within the selected eccentric radial position. After completion of acoustic logging and taking of check-shot data measurements (on the same logging run), the tool 208 can be positioned in the cased region 16 of the wellbore. In this position, the controllers 112,207 can operate the positioning devices 140*a,b* to align the acoustic tool 208 in a substantially concentric position for to collected different data, e.g., data relating to the bonding of the cement to the casing. It should be appreciated that the controller 112,207 can work independently or in cooperation with the surface processor or surface personnel 412. Moreover, the positioning members can be, in certain embodiments, controlled directly from the surface without use of a downhole controller.

It should therefore be appreciated that a module made in accordance with certain embodiments of the present invention can, during a single logging run, position a measurement device in a first radial position to measure a first parameter of interest, then position the measurement device in a second radial position to measure a second parameter of interest, etc. More generally, the present inventors, in certain embodiments, discloses a downhole tool that be selectively positioned to enable the execution of different downhole tasks that may be related or unrelated.

While the foregoing disclosure is directed to the preferred embodiments of the invention, various modifications will be apparent to those skilled in the art. For example, a wireline is merely one suitable conveyance mechanism. Other suitable devices include slickline, coiled tubing (metal or composite), and drill string. It is intended that all variations within the scope and spirit of the appended claims be embraced by the foregoing disclosure.

What is claimed is:

1. A method for performing a downhole operation in a wellbore, comprising:

(a) conveying a tool having a first module proximally connected to a second module into the wellbore, the first module having a selectively adjustable positioning device, the first module having a measurement tool; and (b) actuating the positioning device to selectively position the first module radially relative to a reference point, the first module's relative position being different from the position of the second module relative to the reference point, wherein the first module can be operated in at least two positions relative to the reference point.

2. The method according to claim 1 wherein the reference point is a wellbore axis and the selected position is a radial position selected from one of (i) substantial eccentricity relative to the wellbore axis; and (ii) substantial concentricity relative to the wellbore axis.

3. The method according to claim 1 further comprising controlling the positioning device with a controller.

4. The method according to claim 3 further comprising adjusting the positioning device in response to one of: (i)

preprogrammed data; (ii) a dynamically updated model; and (iii) data signals provided by a sensor coupled to the controller.

5. The method according to claim 1 further comprising attaching the first module to an umbilical selected from one of (i) a wire line; (ii) a slickline; (iii) a coiled tubing; (iv) a drill string and (v) a cable.

6. The method according to claim 1 further comprising moving the first module along the wellbore while operating the measurement tool.

7. The method according to claim 1 further comprising adjusting the position of the first module while the measurement tool is being operated.

8. The method according to claim 7 wherein the measurement tool measures by way of at least one of: (i) resistivity, (ii) NMR, (iii) nuclear, (iv) formation fluid sampling, and (v) acoustic.

9. The method according to claim 1 further comprising:

(a) operating the measurement tool in a first portion of the wellbore;

(b) moving the measurement tool to a second portion of the wellbore;

(b) actuating the positioning device to position the first module in a selected position at the second portion of the wellbore; and (d) operating the measurement tool in the second portion of the wellbore.

10. The method according to claim 1 wherein the second module is the reference point.

11. An apparatus for use in a wellbore in an earth formation, comprising:

(a) an umbilical;

(b) a first module conveyed on the umbilical, the first module including a measurement tool;

(c) a second module conveyed on the umbilical proximally to the first module; and (d) a positioning device associated with the first module, the positioning device being adapted to selectively adjust a radial position of the first module relative to a radial position of the second module, the first module being operable in at least two positions.

12. The apparatus according to claim 11 wherein the positioning device operates with reference to an axis of the wellbore and the selected position is a radial position selected from one of (i) substantial eccentricity relative to a wellbore axis; and (ii) substantial concentricity relative to the wellbore axis.

13. The apparatus according to claim 11 wherein the measurement tool is adapted to measure one of: (i) resistivity, (ii) NMR, (iii) nuclear, (iv) a formation fluid sampling, and (v) acoustic.

14. The apparatus according to claim 11 wherein the positioning device is adapted to maintain the selected position while the first module is moved along the wellbore.

15. The apparatus according to claim 11 wherein the first module has a selected orientation relative to the second module.

16. The apparatus according to claim 11 further comprising a controller configured to control the positioning device.

17. The apparatus to claim 16 wherein the controller is configured to position the first module in response to one of: (i) a preprogrammed criteria; (ii) a dynamically updated criteria; and (iii) signals from a sensor in communication with the controller.

18. The apparatus according to claim 11 wherein the positioning device is configured to alter the position of the first module while the first module is being operated.

19. The apparatus according to claim 11 wherein the umbilical selected from one of (i) a wire line; (ii) a slickline; (iii) a coiled tubing; (iv) a drill string; and (v) a cable.

20. An apparatus for use in a wellbore in an earth formation, comprising:

(a) an umbilical;

(a) a first module conveyed on the umbilical;

(c) a second module conveyed on the umbilical proximally to the first module; and (d) a positioning device associated with the first module, the positioning device being adapted to selectively adjust the position of the first module relative to the second module, the first module being operable in at least two positions, wherein the positioning device is adapted to disengage a measurement tool disposed in the first module from a wall of the wellbore.

21. The apparatus according to claim 20 wherein the measurement tool is adapted to measure one of: (i) resistivity, (ii) NMR, (iii) nuclear, (iv) a formation fluid sampling, and (v) acoustic.

22. The apparatus according to claim 20 wherein the umbilical selected from one of (i) a wire line; (ii) a slickline; (iii) a coiled tubing; (iv) a drill string; and (v) a cable.

23. The apparatus according to claim 20 further comprising a controller configured to control the positioning device.

24. The apparatus to claim 23 wherein the controller is configured to position the first module in response to one of: (i) a preprogrammed criteria; (ii) a dynamically updated criteria; and (iii) signals from a sensor in communication with the controller.

* * * * *